US007527217B2

(12) United States Patent
Burnett

(10) Patent No.: US 7,527,217 B2
(45) Date of Patent: May 5, 2009

(54) TOILET TISSUE ROLL HOLDER SPINDLE WITH AUXILARY TISSUE

(76) Inventor: Allen Garrett Burnett, 3184 Rock Creek Dr., Rex, GA (US) 30273-2440

( * ) Notice: Subject to any disclaimer, the term of this patent is extended or adjusted under 35 U.S.C. 154(b) by 297 days.

(21) Appl. No.: 11/476,449

(22) Filed: Jun. 28, 2006

(65) Prior Publication Data

US 2008/0001020 A1 Jan. 3, 2008

(51) Int. Cl.
*B65H 16/06* (2006.01)

(52) U.S. Cl. ..... 242/597.5; 242/560; 242/599.3

(58) Field of Classification Search ..... 242/599, 242/599.1, 599.2, 599.3, 560, 597.5
See application file for complete search history.

(56) References Cited

U.S. PATENT DOCUMENTS

| | | | | |
|---|---|---|---|---|
| 1,136,700 | A | 4/1915 | Moore | |
| 1,292,640 | A | 1/1919 | Phelps | |
| 2,419,798 | A | 4/1947 | Stone | |
| 2,518,328 | A | 8/1950 | Janonis | |
| 2,801,809 | A * | 8/1957 | Glaner | 242/560 |
| 3,239,158 | A * | 3/1966 | Levesque | 242/599.1 |
| D277,347 | S | 1/1985 | Thompson | |
| 5,100,075 | A | 3/1992 | Morand | |
| 5,255,861 | A * | 10/1993 | Lerner | 242/598 |
| 5,340,047 | A * | 8/1994 | Heller | 242/599.1 |
| 6,007,019 | A | 12/1999 | Lynch et al. | |
| 6,092,760 | A * | 7/2000 | Hedrick | 242/598.3 |
| D452,789 | S | 1/2002 | Zetsche | |
| D477,481 | S | 7/2003 | Ouano | |
| 7,213,783 | B1 * | 5/2007 | Schmatz | 242/598.3 |
| 7,311,286 | B2 * | 12/2007 | Burnett | 242/599 |
| 7,367,524 | B2 * | 5/2008 | Burnett | 242/598.2 |
| 2002/0020780 | A1 | 2/2002 | Otsuji | |
| 2002/0134881 | A1 * | 9/2002 | Hoernig | 242/599.1 |

* cited by examiner

*Primary Examiner*—William A Rivera

(57) ABSTRACT

A spindle to hold standard toilet tissue rolls in common spring-held toilet tissue roll holders, and within that spindle contain an auxiliary tissue roll. The spindle is comprised of two sliding, interlocking, hollow parts with a fastened external spring compressed between them. The male and female parts have stops to compress the spring between them providing tension to anchor the spindle between the arms of toilet tissue roll holders. Each outer end is solid and has a tapered anchor point for variable mounting. The tightly wound auxiliary tissue roll is contained in the spindle hollow compartment.

17 Claims, 2 Drawing Sheets

TOILET TISSUE ROLL HOLDER SPINDLE WITH AUXILARY TISSUE

RELATED APPLICATIONS

Applicant filed patent application Ser. No. 11/182,978 on Jul. 15, 2005 for a Toilet Tissue Roll Holder Axle With Auxiliary Tissue. The present application is similar in nature to that pending application in having a compartment for storing auxiliary toilet tissue.

Applicant filed patent application Ser. No. 11/357,571 on Feb. 17, 2006 for a Wall Mount Toilet Tissue Roll Holder With Auxiliary Tissue. The present application is similar in nature to that pending application in having a compartment for storing auxiliary toilet tissue.

Applicant filed patent application Ser. No. 11/395,037 on Mar. 31, 2006 for a Wall Mount Mechanical Toilet Tissue Roll Holder With Auxiliary Tissue. The present application is similar in nature to that pending application in having a compartment for storing auxiliary toilet tissue.

Applicant filed patent application Ser. No. 11/406,539 on Apr. 19, 2006 for a Pivoting Toilet Tissue Roll Holder With Auxiliary Tissue. The present application is similar in nature to that pending application in having a compartment for storing auxiliary toilet tissue.

FIELD OF THE INVENTION

The present invention relates to toilet tissue holders and, more particularly, to a spindle containing auxiliary tissue to replace spindles in spring held toilet tissue roll holders

BACKGROUND OF THE INVENTION

Since the invention of indoor plumbing people have occasionally been stranded on a toilet without toilet tissue because they did not realize there was very little or none at all nearby when they took a seat. Using whatever alternative material was within reach, moving awkwardly around the restroom area searching for toilet tissue, or calling for help were a few of the available remedies.

Devices to house additional standard toilet tissue rolls in the proximity of a toilet can be found in great number.

Small packages of all sorts of tissue types can be found in great number.

Small rolls of tissue, and dispensers for those rolls are produced for camping or other portable purposes.

The need to solve the problem of running out of toilet tissue while utilizing a toilet is long established. U.S. Pat. No. 2,801,809 filed May 6, 1954 and issued Aug. 6, 1957 to L. O. Glaner addressed the problem.

U.S. Pat. No. 5,255,861 issued Oct. 26, 1993 to Saul Lerner also addressed the problem.

Previous Patent Applications filed by this applicant provide for auxiliary toilet tissue rolls do also address the problem.

Primary, wall mounted holders for the use of standard toilet tissue rolls, and devices for storage of additional standard toilet tissue rolls when empty require replenishment of their supply of standard toilet tissue roll or rolls, and have no provision for a smaller auxiliary amount of tissue when inevitably the need for replenishment is overlooked or ignored.

Standard toilet tissue rolls are too large to provide convenient or discreet concealment on a user's person for use under other circumstances in other locations.

Almost all small packages of differing tissue types or of other design types are not the commonly preferred, perforated roll format for toilet use, and/or they have no adequate means of protection from the rigors of storage and/or travel.

Camping and other portable-need toilet tissue products are designed for an outdoor application and have no capability to be included conveniently in the indoor restroom environment.

The device in U.S. Pat. No. 2,801,809 to Glaner long ago recognized the best location for an auxiliary tissue supply as being the interior of the center tube of a standard toilet tissue roll, and more specifically inside the spindle of a holder. There is no provision to keep that device assembled when it is removed from the confines of a wall mounted holder or brackets to replace the standard toilet tissue roll. There is no provision for that device to retain the spring on its mounting position when the device is opened to access the auxiliary toilet tissue roll. Glaner is a multi-part device with no means of self-containment or part retention when being handled by children or others of limited ability or limited functionality. There is no provision to fit the device in holders or brackets which have mounting holes of varying sizes. Glaner is a spindle for use only in a holder with specific size mounting holes.

The device in U.S. Pat. No. 5,255,861 to Lerner also recognizes the best location for an auxiliary tissue supply as inside the center tube of a toilet tissue roll. The auxiliary tissue roll of Lerner with its hollow center would crush easily, and would have no small protective case so it could be stored outside the restroom setting.

None of the previous Patent Applications filed by this applicant are spindles.

Patent application Ser. No. 11/182,978 filed Jul. 15, 2005 by this applicant for a Toilet Tissue Roll Holder Axle With Auxiliary Tissue is a nonmoving axle with off-center axle mounting points. A great many styles of toilet tissue roll holders designed for use with the common skinny spindle depend on the small diameter of the skinny spindle so the standard size toilet tissue roll can loosely fit and rotate freely. The device in patent application Ser. No. 11/182,978 is a universal replacement axle which moves the center of rotation of the standard toilet tissue roll away from the wall or mounting surface to avoid the interference regularly encountered on a wall mounted device or brackets due to their size or design when maintaining the center of rotation of the standard toilet tissue roll fixedly at the axis of the mounting holes.

SUMMARY OF EMBODIMENTS OF THE INVENTION

In accordance with the present invention, there is provided a spindle to hold a standard toilet tissue roll in the common types of spring-held toilet tissue roll holders, and within that spindle in a hollow compartment contain an auxiliary tissue roll. The body of the spindle shaft is comprised of two interlocking hollow parts, with one part fitting into the other. Each part has a graduated stop allowing a fastened spring to be compressed between them to provide tension. The spindle shaft outer diameter is slightly less than the inner diameter of a standard toilet tissue roll center tube allowing the hollow compartment of the spindle to provide the maximum space for the auxiliary tissue roll. Auxiliary toilet tissue is tightly rolled and contained in the hollow compartment of the invention. A retaining system maintains assembly when the invention is removed from a holder, while allowing for the parts to be separated easily when replacing the standard toilet tissue roll. A clasp device holds the spring in place when accessing the auxiliary tissue roll. Tapered mounting points secure the invention in a standard toilet tissue roll holder and allow the invention to be used in toilet tissue roll holders with mounting holes of any size.

It is therefore an object of the invention to provide an auxiliary tissue roll to those who did not realize there was an inadequate supply of toilet tissue at their disposal before circumstances prevented them from moving about comfortably beyond the immediate area of a toilet they were utilizing.

It is another object of the invention to provide a replacement spindle for common spring-held toilet tissue roll holders that will remain assembled when removed from a wall mounted holder or brackets when replacing a standard tissue roll so to simplify use.

It is another object of the invention to provide a replacement spindle for standard toilet tissue roll holders that will retain a spring at its mounting position when the spindle is opened to access the auxiliary toilet tissue roll within so to simplify use.

It is another object of the invention to provide a replacement spindle for standard toilet tissue roll holders that will fit in a wide variety of holders relative to mounting hole size.

It is another object of the invention to provide an auxiliary tissue roll and protective case of a size that can be transported on one's person discreetly.

It is another object of the invention to provide a strong and durable holder and an auxiliary tissue supply that can be stored in places where it might encounter abuse.

It is another object of the invention to provide a storage location for personal hygiene supplies or other items in a fixed position within an arm's reach of a toilet.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF EMBODIMENTS OF THE INVENTION

Figure 1:
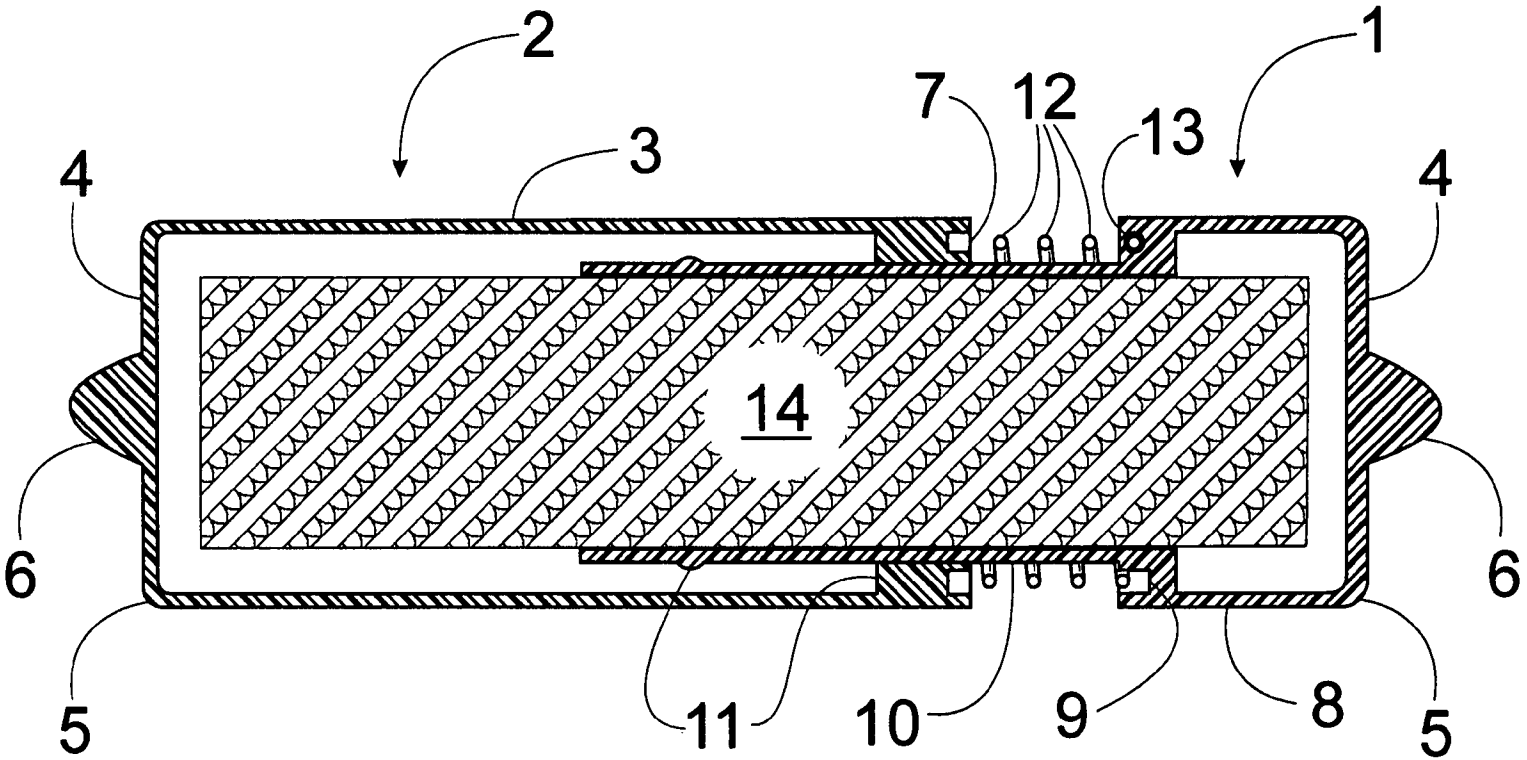
FIG. 1 is a front sectional view of a toilet tissue roll holder spindle containing auxiliary tissue in accordance with the invention.

The at-home situation and the away-from-home situation both need to be solved by a single entity so a tissue manufacturer can produce a universal tissue product thereby keeping the final cost to the consumer as low as possible. Since standard toilet tissue rolls designed for home use have a universal length and inside diameter, that space should set the standard for an auxiliary tissue size.

The invention is a replacement spindle for the most common type of spring-held standard toilet tissue roll holder spindles. The invention has a hollow compartment where an auxiliary tissue roll is stored. The invention has a retaining system to hold the primary parts together when removing it from a wall mounted holder to replace the standard toilet tissue roll so to be uncomplicated and not clumsy to handle. The spring that provides tension to hold the invention in place in standard toilet tissue roll holders is mounted on the exterior of the spindle shaft so as not to damage the contents of the hollow compartment. The invention has a clasp device to hold the spring in place when the invention is opened to access the auxiliary toilet tissue roll so to be uncomplicated and not clumsy to handle. Fixtures for holding standard toilet tissue rolls vary greatly in every aspect of their design and engineering. There is no standard or average size spindle mounting hole diameter. The invention has tapered mounting points which taper to fit the smallest hole sizes up to the largest hole sizes.

An amount of toilet tissue necessary for only a single user is required when discovery of an inadequate or depleted supply of toilet tissue is made at an inopportune time. The invention provides at least that amount of auxiliary tissue by maximizing the size of the replacement axle relative to the inside diameter of standard toilet tissue rolls.

Away from the standard toilet tissue roll holder, the spring removed, and carried in hand, pocket, purse or other means the invention is a protective case with an adequate supply of tissue that provides the user with a discreet and portable solution should the user be forced to utilize a toilet away from their home where an inadequate or depleted supply of toilet tissue might be found, or where toilet facilities are absent, or be forced to utilize a public toilet where the provided toilet tissue supply could have been tampered with, or where the provided toilet tissue supply is inferior in quality to what the user requires.

The auxiliary tissue roll of the invention can be removed and the hollow compartment used instead to store other personal hygiene products or other items sometimes required when utilizing a toilet, and no other close or discreet storage location is available.

Standard toilet tissue roll holders have spindle shafts much smaller than the center tube of standard toilet tissue rolls causing wobbling when unrolling. The invention is a spindle only slightly smaller than the center tube of standard toilet tissue rolls and provides a smooth unrolling action.

The invention is strong enough and durable enough to be stored for quite some time in a great number of places such as automobiles, boats, backpacks or other locations where abuse could be severe, and still provide the user with an intact and adequate supply of tissue should an inopportune moment present itself.

FIG. 1 is a sectional front view of a toilet tissue roll holder spindle with auxiliary tissue in accordance with the invention. A male part 1 and a female part 2 are made of plastic, metal, wood or other suitable material. The male part 1 and the female part 2 when assembled establish a hollow protective cover for contents. The male part 1 and the female part 2 when assembled establish a toilet tissue roll spindle. The male part 1 can be constructed as one piece or as multiple pieces. The female part 2 can be constructed as one piece or as multiple pieces.

The male part 1 and the female part 2 each have a solid end 4. Each solid end 4 has a rounded edge 5 facilitating easy insertion of the invention into the center tube of a toilet tissue roll. Each solid end 4 mounts an anchor point 6 located on the axial center-line of the invention. Each anchor point 6 is tapered so the invention will fit snugly into a wide variety of toilet tissue roll holders relative to mounting hole size.

The female part 2 has a hollow smooth shaft 3. The shaft 3 provides space to hold an auxiliary tissue roll 14. One end of the female part 2 has a spring ram 7 to press against a spring 12 so the spring 12 provides tension axially between the female part 2 and the male part 1 to hold the invention between the brackets or arms of a toilet tissue roll holder. The spring ram 7 has an opening to provide alignment with the male part 1. The spring 12 is made of metal, plastic, or other suitable material.

The male part 1 has a hollow smooth shaft knob 8. The shaft knob 8 provides space to hold an auxiliary tissue roll 14. During handling, use of the shaft knob 8 prevents interference with the action of the spring 12. One end of the shaft knob 8 has a spring channel 9 to align the spring 12 and press against the spring 12 so the spring 12 provides tension axially between the male part 1 and the female part 2 to hold the invention between the brackets or arms of a toilet tissue roll holder. Extending from the spring channel 9 is a smooth hollow spring shaft 10. The spring shaft 10 provides space to hold an auxiliary tissue roll 14, provides a surface for the spring 12 to flex over, and aligns the male part 1 with the opening in the spring ram 7 of the female part 2.

A retaining system 11 maintains assembly of the invention when removed from a toilet tissue roll holder. The retaining system 11 can be constructed as one piece or as multiple pieces. The retaining system 11 can be mechanical, adhesive, or other suitable systems. The retaining system 11 can be visible or hidden. In this embodiment the retaining system 11 is a compressible tapered ridge along the outer diameter of the spring shaft 10 of the male part 1, and a flexible graduated opening behind the spring ram 7 of the female part 2. The outer diameter of the tapered ridge is slightly greater than the inner diameter of the opening in the spring ram 7. The level of compressibility of the tapered ridge and the level of expandability of the spring ram 7 allow the male part 1 and the female part 2 to be easily assembled by someone pressing the male part 1 and the female part 2 together. Assembled, the retaining system 11 cannot be overcome by the spring 12 tension. The retaining system 11 can be overcome by a small amount of force generated by someone pulling the male part 1 and the female part 2 in opposite directions.

A clasp device 13 holds the spring 12 in its mounting position when the male part 1 and the female part 2 are pulled apart. The clasp device 13 can be constructed as one piece or as multiple pieces. The clasp device 13 can be mechanical, adhesive, or other suitable systems. The clasp device 13 can be visible or hidden. In this embodiment the clasp device 13 is a dam in the spring channel 9 with a hole in line with the spring channel 9 for an end of the spring 12 to pass thru.

The auxiliary tissue roll 14 is a solid roll of tightly wound tissue with perforations common to rolled toilet tissue.

Figure 2:
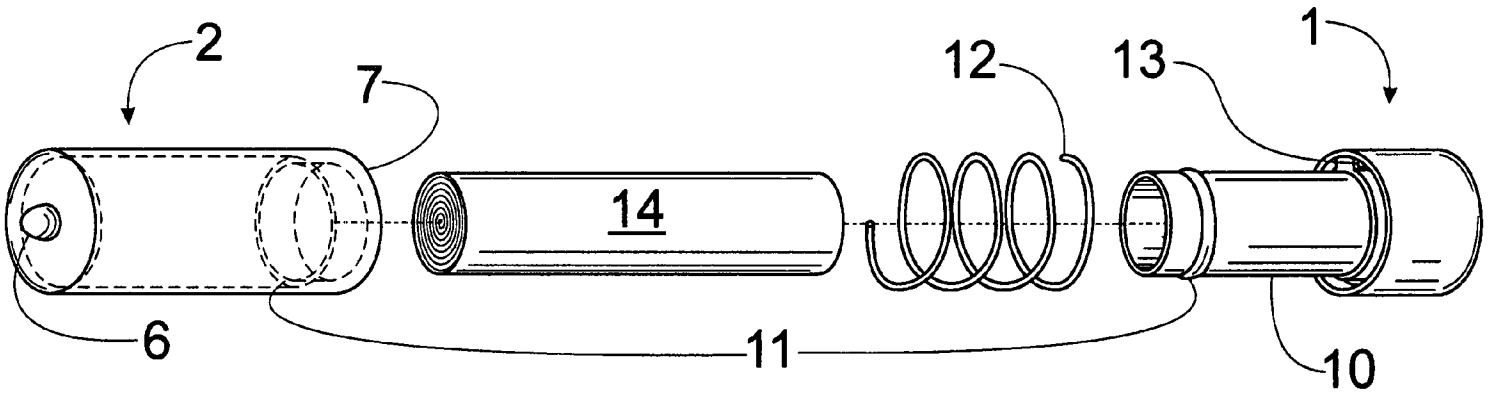
FIG. 2 is an exploded perspective view of a toilet tissue roll holder spindle containing auxiliary tissue in accordance with the invention.

FIG. 2 is an exploded perspective view of a toilet tissue roll holder spindle with auxiliary tissue in accordance with the invention showing the male part 1, the spring 12, the auxiliary tissue roll 14 and the female part 2. In this embodiment assembly of the invention is to place the spring 12 over the spring shaft 10. Align and insert one end of the spring 12 into the clasp device 13. Insert the auxiliary tissue roll 14 into the hollow compartment of the male part 1. Insert that assembly into the hollow compartment of the female part 2 thru the opening in the spring ram 7 far enough to engage the retaining system 11. Mounting into a toilet tissue roll holder requires pressing the device from the ends to compress the spring 12 until each anchor point 6 can be inserted into a mounting hole on a bracket or arm of the toilet tissue roll holder, then releasing the ends and allowing the spring 12 to expand. Extraction by reversing the process.

Figure 3:
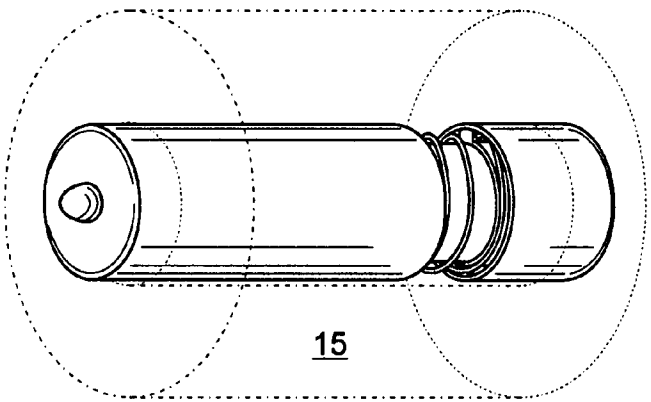
FIG. 3 is an assembled perspective view of a toilet tissue roll holder spindle containing auxiliary tissue in accordance with the invention supporting a standard toilet tissue roll.

FIG. 3 is an assembled perspective view of the invention supporting a standard toilet tissue roll 15.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A toilet tissue roll holder spindle with auxiliary tissue, comprising:

an insertion component defining a first space at least partially hold the auxiliary tissue roll;

a receiving component defining a second space to at least partially hold the auxiliary tissue and to support an outer toilet tissue roll;

a first base formed to said receiving component;

a second base formed to said insertion component;

tapered means for mounting the toilet tissue roll holder spindle in toilet tissue roll holders with small to large mounting holes formed to said each of the first base and the second base;

a first stop configured to press against a spring, coupled to the receiving component;

a spring shaft disposed about at least a portion of said receiving component;

means for holding the insertion component in a user's hand without interfering the spring formed to said insertion component;

a second stop configured to press against the spring formed to said insertion component;

means for retaining the insertion component and the receiving component together when the toilet tissue roll holder spindle is not disposed within a toilet tissue roll holder or brackets, wherein the means for retaining is configured as a first portion affixed to said receiving component and a second portion affixed to said insertion component;

the spring, disposed about the spring shaft between the first stop and the second stop;

means for holding the spring about the spring shaft when accessing the auxiliary tissue roll affixed to said insertion component; and the auxiliary toilet tissue inserted within at least a portion of said receiving component and within at least a portion of said insertion component.

2. The toilet tissue roll holder spindle with auxiliary tissue in accordance with claim 1, wherein said insertion component comprises a male part.

3. The toilet tissue roll holder spindle with auxiliary tissue in accordance with claim 1, wherein said receiving component comprises a female part.

4. The toilet tissue roll holder spindle with auxiliary tissue in accordance with claim 1, wherein said receiving component defines a hollow, smooth shaft.

5. The toilet tissue roll holder spindle with auxiliary tissue in accordance with claim 1, wherein at least one of the first base or the second base comprises a substantially flat solid end.

6. The toilet tissue roll holder spindle with auxiliary tissue in accordance with claim 1, wherein said tapered means for mounting the toiler tissue roll holder spindle in toilet tissue roll holders with small to large mounting holes comprises a tapered anchor point.

7. The toilet tissue roll holder spindle with auxiliary tissue in accordance with claim 1, wherein said first stop comprises a spring ram.

8. The toilet tissue roll holder spindle with auxiliary tissue in accordance with claim 1, wherein said means for holding the insertion component in the user's hand without interfering with the spring comprises a smooth shaft knob.

9. The toilet tissue roll holder spindle with auxiliary tissue in accordance with claim 1, wherein said second stop comprises a spring channel.

10. The toilet tissue roll holder spindle with auxiliary tissue in accordance with claim 1, wherein said insertion component further comprises a hollow, smooth spring shaft.

11. The toilet tissue roll holder spindle with auxiliary tissue in accordance with claim 1, wherein said means for retaining the insertion component and the receiving component together comprises one of a mechanical or adhesive.

12. The toilet tissue roll holder spindle with auxiliary tissue in accordance with claim 1, wherein said spring comprises one of a metal spring or a plastic spring.

13. The toilet tissue roll holder spindle with auxiliary tissue in accordance with claim 1, wherein said means for holding the spring about the spring shaft when accessing the auxiliary tissue roll comprises a clasp device.

14. The toilet tissue roll holder spindle with auxiliary tissue in accordance with claim 1, wherein said auxiliary toilet tissue comprises a wound, perforated tissue roll.

15. A toilet tissue roll holder spindle with auxiliary tissue for providing auxiliary tissue at a toilet, comprising:

a male spindle part defining a spring shaft;

a female spindle part defining a hollow, smooth shaft;

a first substantially flat solid end sealing one end of the hollow, smooth shaft formed to said female spindle part, and a second substantially flat solid end formed to said male spindle part;

a first tapered anchor point formed to said first substantially flat solid end and a second tapered anchor point formed to said second substantially flat solid end;

a spring ram formed to said female spindle part;

a smooth shaft knob formed to said male spindle part;

a spring channel formed to said male spindle part;

a retaining system configured to retain the male spindle part and the female spindle part together when biased apart by a spring;

one of a metal or a plastic spring configured to apply outward tension axially between the male spindle part and the female spindle part, disposed about said spring shaft, and within said spring channel;

a clasp device configured to retain said spring to said male spindle part; and a wound auxiliary tissue roll inserted into said female spindle part, and inserted at least partially into said male spindle part.

16. The toilet tissue roll holder spindle with auxiliary tissue as recited in claim 15, wherein each of the first substantially flat solid end and the second substantially flat solid end define a rounded edge about a periphery of said solid end.

17. A toilet tissue roll holder spindle with auxiliary tissue, comprising:

a male part;

a female part;

a hollow, smooth shaft emanating from said female part;

a substantially flat solid end sealing the hollow, smooth shaft at a first end the substantially flat solid end defining a rounded edge for insertion of the toilet tissue roll holder spindle into a center of a toilet tissue roll holder;

a tapered anchor point formed to said substantially flat solid end;

a spring ram formed to said female part;

a smooth shaft knob formed to said male part;

a spring channel formed to said male part;

a hollow, smooth spring shaft emanating from said male part;

a mechanical or adhesive retaining system configured to retain the male part and female part together when biased apart by a spring;

a metal or plastic spring encircling said spring shaft, and fitted to said spring channel;

a clasp device for holding the spring about the spring shaft when accessing an auxiliary tissue roll; and a wound, perforated auxiliary tissue roll inserted partially to said female part, and inserted partially to said male part.

* * * * *